US007218282B2

(12) United States Patent
Humpfer et al.

(10) Patent No.: US 7,218,282 B2
(45) Date of Patent: May 15, 2007

(54) ANTENNA DEVICE

(75) Inventors: Harald Humpfer, Erlangen (DE); Rainer Wansch, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 11/260,985

(22) Filed: Oct. 27, 2005

(65) Prior Publication Data

US 2006/0109179 A1 May 25, 2006

Related U.S. Application Data

(63) Continuation of application No. PCT/EP04/04482, filed on Apr. 28, 2004.

(30) Foreign Application Priority Data

Apr. 28, 2003 (DE) ..... 103 19 093

(51) Int. Cl.
*H01Q 1/24* (2006.01)

(52) U.S. Cl. ..... 343/700 MS; 343/702

(58) Field of Classification Search ..... 343/700 MS, 343/702, 725, 728, 846, 848
See application file for complete search history.

(56) References Cited

U.S. PATENT DOCUMENTS 6,404,395 B1 6/2002 Masuda
6,812,892 B2 * 11/2004 Tai et al. ..... 343/700 MS
6,864,841 B2 * 3/2005 Dai et al. ..... 343/700 MS
6,897,810 B2 * 5/2005 Dai et al. ..... 343/700 MS
2001/0043159 A1 11/2001 Masuda et al.
2002/0024466 A1 2/2002 Masuda

FOREIGN PATENT DOCUMENTS

| | | |
|---|---|---|
| DE | 10142384 | 3/2002 |
| JP | 200223108 | 8/2002 |
| JP | 2002223108 | 8/2002 |
| JP | 2003284398 | 10/2003 |
| WO | WO01/33665 A1 | 5/2001 |

OTHER PUBLICATIONS

Wong, K., et al. "Panar Antennas for Wireless Communication." John Wiley and Sons, Inc., Hoboken, NJ, USA, 2003, pp. 26-53.

(Continued)

*Primary Examiner*—Shih-Chao Chen
(74) *Attorney, Agent, or Firm*—Michael A. Glenn; Glenn Patent Group

(57) ABSTRACT

An antenna device includes a first radiation electrode having an open end and a short-circuited end connected to ground and being coupled to a feed line at a feeding point. Furthermore, the antenna device has a second radiation electrode having an open end and a short-circuited end connected to ground, wherein a portion of the second radiation electrode is part of an electric circuit. The first radiation electrode, the feed line and the electric circuit are arranged such that an alternating current through the feed line to the short-circuited end of the first radiation electrode, for feeding the second radiation electrode, induces an alternating current into the electric circuit via magnetic coupling.

7 Claims, 6 Drawing Sheets

OTHER PUBLICATIONS

Liu, Z., et al. "Dual-Frequency Planar Inverted-F Antenna." IEEE Transactions on Antennas and Propagation. vol. 45, No. 10, Oct. 1997.

Guo, Y., et al. "A Quarter-Wave U-Shaped Patch Antenna With Two Unequal Arms for Wideband and Dual-Frequency Operation." IEEE Transactions on Antennas and Propagation. vol. 50, No. 8, Aug. 2002.

Lui, G., et al. "Compacy Dual-Frequency PIFA Designs Using LC Resonators." IEEE Transactions on Antennas and Propagation. vol. 49, No. 7, Jul. 2002.

Fei, L., et al. "Method Boosts Bandwidth of IFAs for 5-GHz WLAN NICs." Microwaves & RF. Sep. 2002.

Korean Intellectual Property Office, "Notice of Reasons for Rejection", (English translation), Oct. 26, 2006, 1 page.

Korean Intellectual Property Office, "Notice of Reasons for Rejection", (Korean language), Oct. 26, 2006, 3 pages.

Japanese Patent Office, "Automatic Translation of JP 2002-223108", Aug. 9, 2002, pp. 1-8.

* cited by examiner

ANTENNA DEVICE

CROSS-REFERENCE TO RELATED APPLICATION

This application is a continuation of copending International Application No. PCT/EP04/004482, filed Apr. 28, 2004, which designated the United States and was not published in English, and is incorporated herein by reference in its entirety.

BACKGROUND OF THE INVENTION

1. Field of the Invention

The present invention relates to an antenna device and, in particular, to an antenna device suitable for multi-band operation. The present invention relates to an antenna for wireless data transmission, which may also include voice transmission.

2. Description of Related Art

For a wireless connection of mobile data processing devices, such as, for example, in wireless local area networks (WLAN), compact small antennas which often need to be dual-band- or multi-band-capable are required.

For this purpose, separate antennas may be used in practice for each frequency range. These separate antennas are, for example, connected to a diplexer in the form of a directional filter or to a multiplexer by means of which the signals to be transmitted are distributed to the respective individual antennas corresponding to the frequency ranges used. The disadvantage of using separate antennas for each frequency range is the size of the individual antennas, the area required for the antennas increasing with an increasing number of antennas required. Additionally, the required distributing circuit in the form of a diplexer or a multiplexer consumes a considerable amount of space.

Another known approach is to use antennas which have a very broad band or are multi-band-capable. In Kin-Lu Wong "Planar Antennas for Wireless Communications", John Wiley and Sons, Inc., Hoboken, N.J., USA, 2003, pp. 26 to 53, several dual-/multi-band antennas in particular for being used in wireless local area networks are explained. Integrated IFAs (IFA=inverted F antenna) and PIFAs (PIFA=planar inverted F antenna) are, among other things, described there.

Dual-band PIFAs described in the above-mentioned document include, on a main surface of a substrate, different antenna patches realized by slots in an electrode formed on the surface, the antenna patches being fed via a common feeding point and connected to ground via a common short-circuited point. Antennas of this kind are also described in Zi Dong Liu et al., "Dual-Frequency Planar Inverted F Antenna", IEEE Transactions on Antennas and Propagation, Vol. 45, No. 10, October 1997, pp. 1451 to 1458.

This document by Kin-Lu Wong (pages 226 ff.) also describes an integrated dual-band antenna in the form of a stacked IFA antenna. Two IFA antennas are "stacked" and galvanically excited via a microstrip line. This antenna may also be employed for wireless local area networks.

Additionally, dual-band PIFAs in which an antenna patch is galvanically fed by a feeding point, whereas a second antenna patch is fed by a capacitive coupling to the galvanically fed antenna patch, is described in the document mentioned. Antenna patches of this kind having capacitive coupling are also described in Yong-Xin Guo et al., "A Quarter-Wave U-Shaped Patch Antenna With Two Unequal Arms for Wideband and Dual Frequency Operation", IEEE Transactions on Antennas and Propagation, Vol. 50, No. 8, August 2002, pp. 1082 to 1087.

Another way of implementing a dual-band antenna in which the antenna patch is lengthened or shortened in a frequency-selective way via an LC resonator or a chip inductor connected therebetween, is also known from the above-mentioned document by Kin-Lu Wong and also described in Gabriel K. H. Lui et. al., "Compact Dual-Frequency PIFA Designs Using LC Resonators", IEEE Transactions on Antennas and Propagation, Vol. 49, No. 7, July 2001, pp. 1016 to 1019.

A non-planar broad-band antenna using a radiation coupling technique is described in Louis F. Fei et al., "Method Boosts Bandwidths of IFAs for 5-GHz WLAN NICs, Microwaves and RF", September 2002, pp. 66 to 70. The bandwidth of the antenna is extended in a non-planar integrated IFA antenna by means of the radiation-coupled resonating of another IFA antenna.

It can be denoted in general that IFA antennas most often have a greater bandwidth compared to PIFA antennas, wherein most integrable dual-band concepts are of disadvantage due to a smaller bandwidth or due to an increased area demand.

SUMMARY OF THE INVENTION

It is an object of the present invention to provide an antenna device having a simple setup and a dual-band or multi-band capability or a great bandwidth.

In accordance with a first aspect, the present invention provides an antenna device having a first radiation electrode having an open end and a short-circuited end connected to ground and being coupled to a feed line at a feeding point, wherein the feed line and a portion of the first radiation electrode between the feeding point and the short-circuited end define an exciter loop; a second radiation electrode having an open end and a short-circuited end connected to ground, wherein a portion of the second radiation electrode is part of a conductor loop through which an alternating current may flow, wherein the exciter loop and the conductor loop are arranged spatially adjacent to each other such that an alternating current through the feed line to the short-circuited end of the first radiation electrode, for feeding the second radiation electrode, induces an alternating current into the conductor loop via magnetic coupling, wherein the second radiation electrode is arranged oh a surface of a substrate on which, additionally, a ground area to which the short-circuited end of the second radiation electrode is connected is arranged, wherein, additionally, a coupling point of the second radiation electrode is connected to the ground area via a coupling conductor such that the part of the second radiation electrode between the short-circuited end and the coupling point, the coupling conductor and the ground area define the conductor loop through which an alternating current may flow.

In preferred embodiments of the inventive antenna device, the first radiation electrode and the feed line are arranged on a first main surface of a substrate, whereas the second radiation electrode is arranged on a second surface of the substrate opposite the first surface. The second electrode is preferably part of a conductor loop, through which an alternating current may flow, which can be infiltrated by a magnetic field generated by an alternating current through the feed line to the short-circuited end of the first radiation electrode, such that the feeding current for the second radiation electrode is induced into the conductor loop. In further preferred embodiments of the present invention, the first radiation electrode and the feed line define an exciter loop such that the conductor loop to which the second radiation electrode contributes is fed by a mutual induction of two spatially neighboring conductor loops.

The two radiation electrodes of the inventive antenna device preferably comprise different lengths and thus different resonant frequencies so that the inventive antenna device may also be used as a dual-band antenna. The radiation electrodes, however, may also comprise such resonant frequencies that an antenna having an increased bandwidth compared to an antenna with only one radiation electrode is obtained. The inventive antenna device may also comprise more than two radiation electrodes and thus be employed as a multi-band antenna.

The inventive antenna or antenna device may be integrated in a planar way, which is of advantage due to its small size in particular with transmission frequencies in the centimeter and millimeter wave range. Preferred fields of application of the inventive antenna are in mobile transmitters and receivers utilizing two or more frequency bands or requiring a high bandwidth. Thus, the present invention is, for example, extraordinarily suitable for a wireless LAN connection of mobile data processing devices, since frequency ranges from 2400 to 2483.5 MHz and 5150 to 5350 MHz are for example used there (Europe). Furthermore, frequency ranges from 5470 to 5725 MHz and the ISM band from 5725 to 5825 MHz may also be used (USA). In addition, the inventive antenna is also suitable for being employed in dual-band or multi-band mobile phones (900 MHz/1800 MHz, etc.). Due to its small size and the capability of being integrated on planar circuits, the inventive antenna is, among other things, suitable for being integrated on PCMCIA-WLAN adapter cards for laptop computers.

In a preferred embodiment, the inventive antenna for wireless data transmission is an integrated dual-band antenna which is, for example, provided for being used in the WLAN ranges of 2.45 GHz and 5.2 GHz. The inventive principle, however, may also be extended to more than two bands and different frequencies.

The inventive antenna device is preferably implemented as an integrated IFA antenna in which, in contrast to conventional integrated IFAs, only a single element, i.e. the first radiation electrode, is fed galvanically. The other element or the other elements (the second and further radiation electrodes) are coupled inductively. The result is a decrease in manufacturing cost and area demand, in particular when the antenna is implemented using a multi-layered concept. The area demand of the entire antenna is only determined by the size of the antenna element for the lowest frequency. As is typical in IFA antennas, the inventive antenna is also characterized by a high bandwidth which is above average for planar antennas.

The inductive coupling and the characteristic wave impedance of the antenna elements, i.e. of the radiation electrodes, can be optimally adjusted by the substrate thickness, the substrate material (the permittivity thereof), the shape of the feed line and a displacement of the feeding point.

The inventive antenna stands out from multi-band concepts known up to now by optimal adjustability, minimum area demand, high bandwidth and small manufacturing cost. The antenna can be integrated in a completely planar way on a substrate (dual-band) or on a multi-layered substrate (multi-band). In preferred embodiments of the present invention, the only thing required is a ground through-connection at the short-circuited side of the radiation electrodes.

BRIEF DESCRIPTION OF THE DRAWINGS

Preferred embodiments of the present invention will be detailed subsequently referring to the appended drawings, in which.

DESCRIPTION OF PREFERRED EMBODIMENTS

Figure 1:
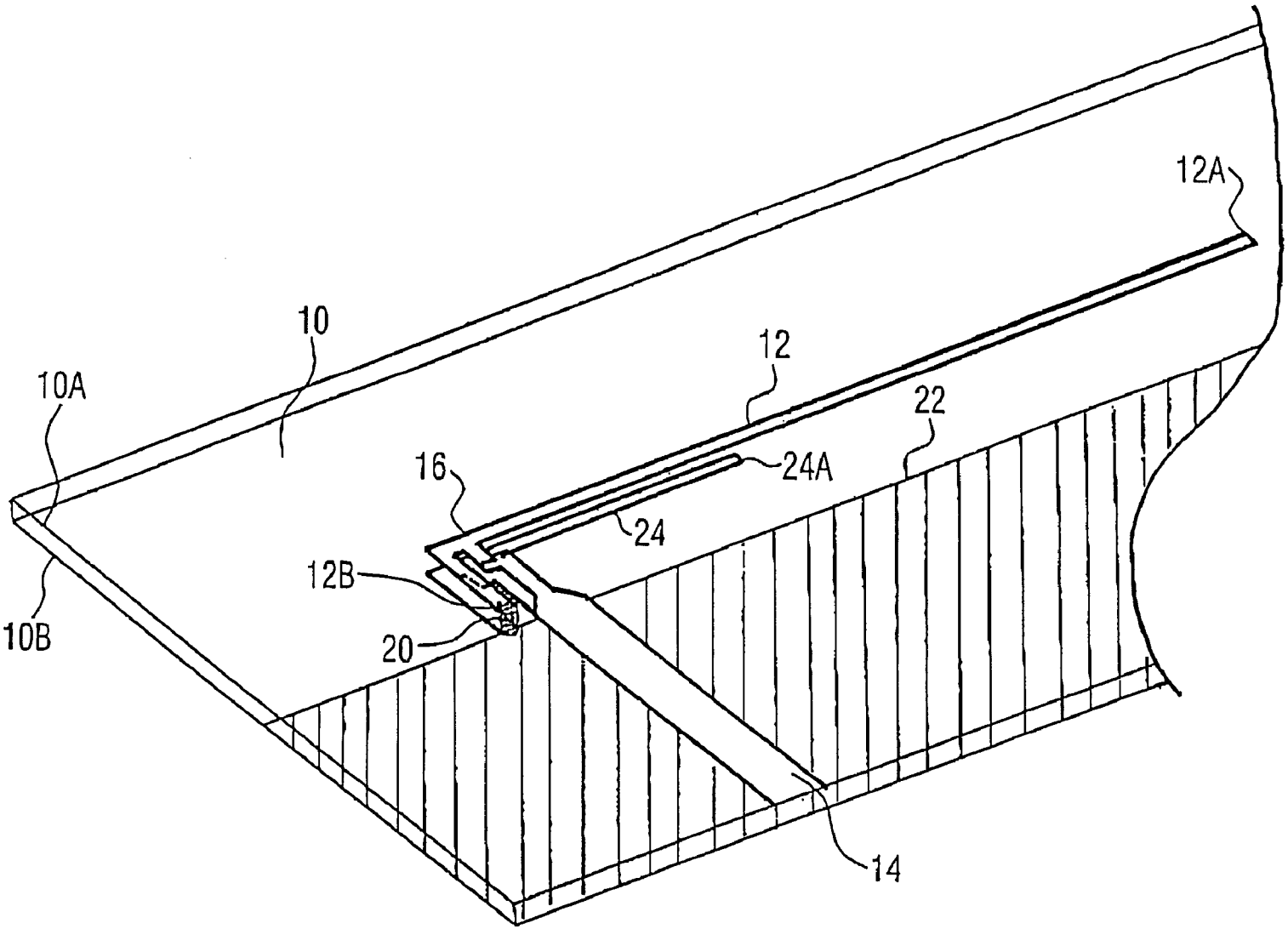
FIG. 1 is a schematic illustration of a first embodiment of an inventive antenna device.

An embodiment of an inventive antenna device implemented on a double-sided substrate 10 is shown in FIG. 1. It is to be pointed out here that the substrate is illustrated in a transparent manner in FIG. 1 for reasons of clarity. The inventive antenna device illustrated in FIG. 1 principally includes two integrated IFAs (inverted F antennas), one of the antennas being formed on a top side 10*a* of the substrate 10, the other one being formed on a bottom side 10*b*.

Figure 2A:
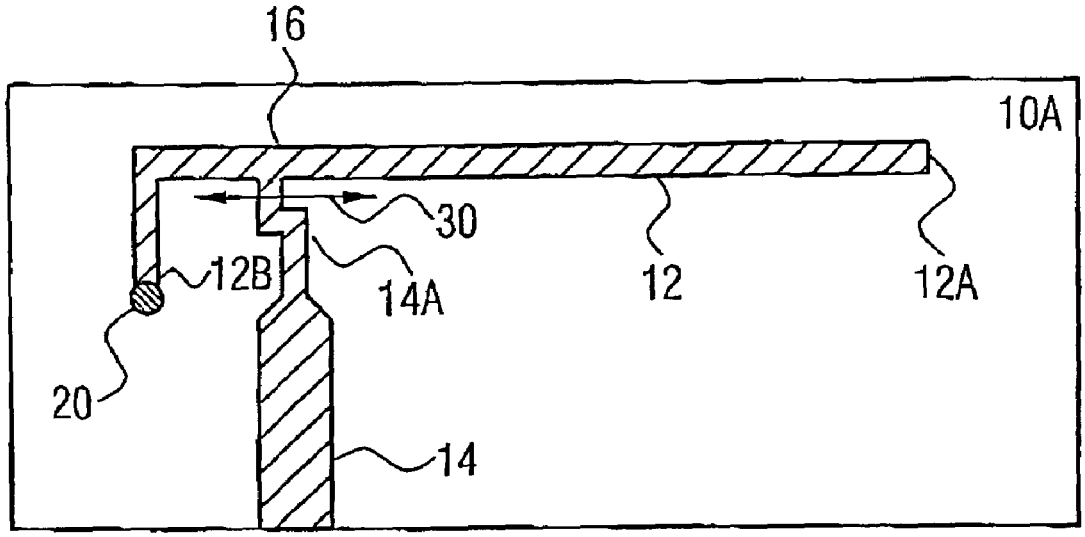
FIGS. 2*a* and 2*b* are schematic illustrations for explaining the embodiments shown in FIG. 1.

A first radiation electrode 12 comprising an open end 12*a* and a short-circuited end 12*b* is formed on the main surface 10*a* of the substrate 10 corresponding to the top side. Additionally, a supply line 14 for galvanically feeding the first radiation electrode 12 is provided on the main surface 10*a*. The supply line 14 is connected to the first radiation electrode 12 at a feeding point 16. With regard to the structure of the metallizations provided on the main surface 10*a*, i.e. the electrodes and lines provided there, reference is made to FIG. 2*a* representing a top view of the top side 10*a* of the relevant part of the substrate 10.

Figure 2B:
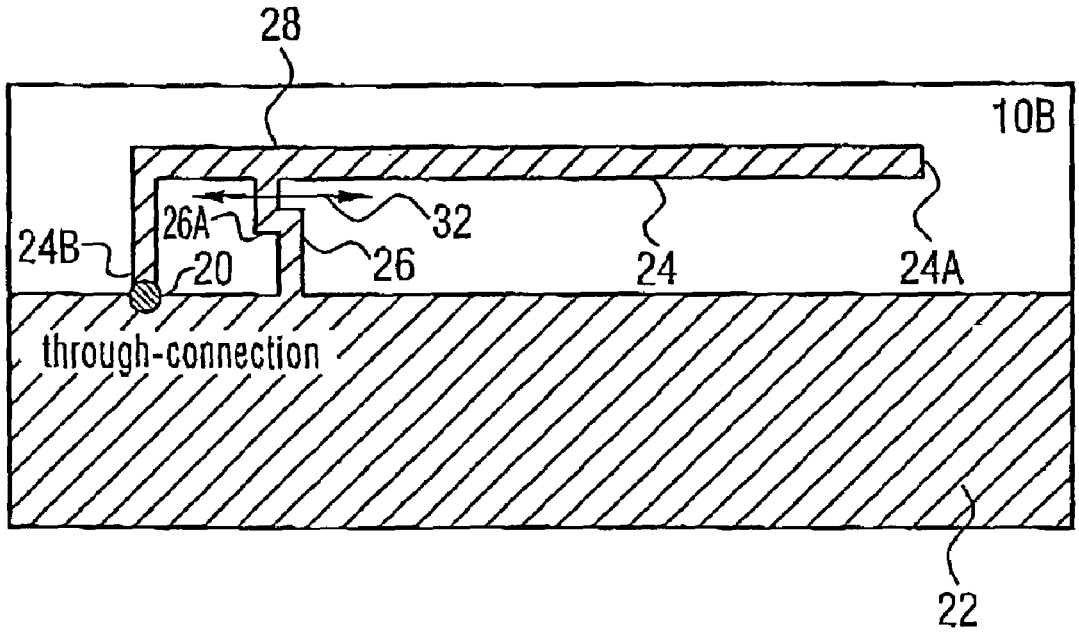

The short-circuited end 12*b* of the first radiation electrode 12 is connected to a ground electrode 22 (in FIG. 1 illustrated in a hatched manner) formed on the main surface 10*b* of the substrate 10 opposite the main surface 10*a*, via a through-connection 20. This opposite main surface 10*b* (the back side in FIG. 1) is illustrated in FIG. 2*b* as a "shine-through image" from above, wherein the metallizations provided on the front side 10*a* are omitted for reasons of clarity and the substrate is transparent. As can best be seen in FIG. 2*b*, a second radiation electrode 24 comprising an open end 24*a* and a short-circuited end 24*b* is formed on the main surface 10*b*. The short-circuited end 24*b* is connected to the ground electrode 22. Additionally, a coupling conductor 26 comprising a first end connected to the ground electrode 22 and a second end connected to the second radiation electrode 24 at a coupling point 28 is formed on the main surface 10*b*.

The ground electrode is provided as a back side metallization on the bottom side of the substrate and also serves as a ground level for the microstrip line 14 and the antennas. The galvanically fed, longer first radiation electrode 12 is provided for the lower frequency band, whereas the inductively fed, shorter antenna 24 is provided for the upper frequency band.

The antenna shown in FIG. 1, in principle, consists of two integrated IFAs, the first one of the two antennas for the first frequency band being fed by the supply line 14 in the form of a microstrip line. The second antenna for the second frequency band comprising the second radiation electrode 24 is inductively excited via a current loop. In particular, in the embodiment illustrated, the supply line 14 and the portion of the first radiation electrode 12 between the short-circuited end 12*b* and the feeding point 16 form an exciter current loop generating a magnetic flux. Additionally, the coupling line 26, the area of the second radiation electrode 24 between the short-circuited end 24*b* and the coupling point 28, and the ground electrode 22 form an electric circuit. This electric circuit, in the inventive antenna device, is arranged such that it is infiltrated by the magnetic flux generated by the exciter current loop such that a current is induced into this current loop. The second radiation electrode 24 is fed by this induced current.

In order to obtain the best possible magnetic coupling, in the embodiment illustrated, the dimensions of the excited current loop formed on the back side 10*b* roughly corresponds to the dimensions of the exciter loop formed on the front side 10*a*. The thickness of the substrate 10 may, for example, be 0.5 mm so that the spacing of the current loops on the top side and bottom side of the substrate, respectively, is small (compared to the wave length at the resonant frequency of the radiation electrode 24) such that good magnetic coupling can be achieved.

In the embodiment shown, the radiation electrode 24 is thus excited inductively by magnetic coupling, the intensity of the coupling depending on the mutual inductivity between the excitation conductor and the excited conductor. The size and form of the exciter current loop and of the excited current loop can be adjusted to obtain a desired coupling. Additionally, the coupling depends on the mutual distance of the loops.

It is to be pointed out here that the exciter current loop and the excited current loop need not be closed current loops formed on the substrate but may be formed as conductor regions which, together with conductors not formed on the substrate, form an alternating current circuit or current loop. The exciter current loop need only have one course to generate a sufficient magnetic field or a sufficient magnetic flux such that a current sufficient for a feeding current can be induced into the part of the electric circuit of the second antenna element which is arranged in the magnetic field or the magnetic flux. Additionally, it is to be pointed out that the respective current loops or electric circuits are formed in a way suitable for enabling an alternating current flow such that capacitive couplings may be provided within these current loops or electric circuits.

The feeding point 16 is selected to obtain impedance matching between the microstrip line 14 and the radiation electrode 12. The respective position for the feeding point 16 must be determined when designing the antenna, wherein the antenna impedance may be diminished by shifting the feeding point 16 to the left, whereas it can be increased by shifting the feeding point 16 to the right, as is indicated in FIG. 2*a* by an arrow 30. The antenna impedance can thus be adjusted to the impedance of the galvanic supply by correspondingly selecting the feeding point 16.

In the same way, matching between the antenna impedance of the second radiation electrode 24 and the coupling line 26 can be obtained by suitably selecting the coupling point 28, as is shown in FIG. 2*b* by an arrow 32. It can be achieved by this matching that the current induced may be utilized optimally for feeding the second radiation electrode.

Even though in the embodiment shown in FIGS. 2*a* and 2*b* the supply line 14 and the coupling line 26 are coupled to the part of the respective radiation electrode parallel to the edge of the ground electrode 22, each of these lines could also be coupled to that part of the respective radiation electrode perpendicular to the edge of the ground electrode 22, depending on how it is necessary to obtain impedance matching.

The entire geometry of the inventive antenna device may be reduced to obtain, for example, a minimization of the area demand by, for example, forming the radiation electrodes or at least the longer one thereof in a meandering shape.

The shape of the feed line 14*a* and the coupling line 26 and the selection of the feeding point and the coupling point 26 may differ for obtaining impedance matching for the two radiation electrodes to allow optimum matching for the two individual antenna elements. The bend 14*a* in the supply line 14 and the bend 26*a* in the coupling line 26 may, for example, be provided in the embodiment shown in FIGS. 1 and 2 to obtain impedance matching.

Figure 3:
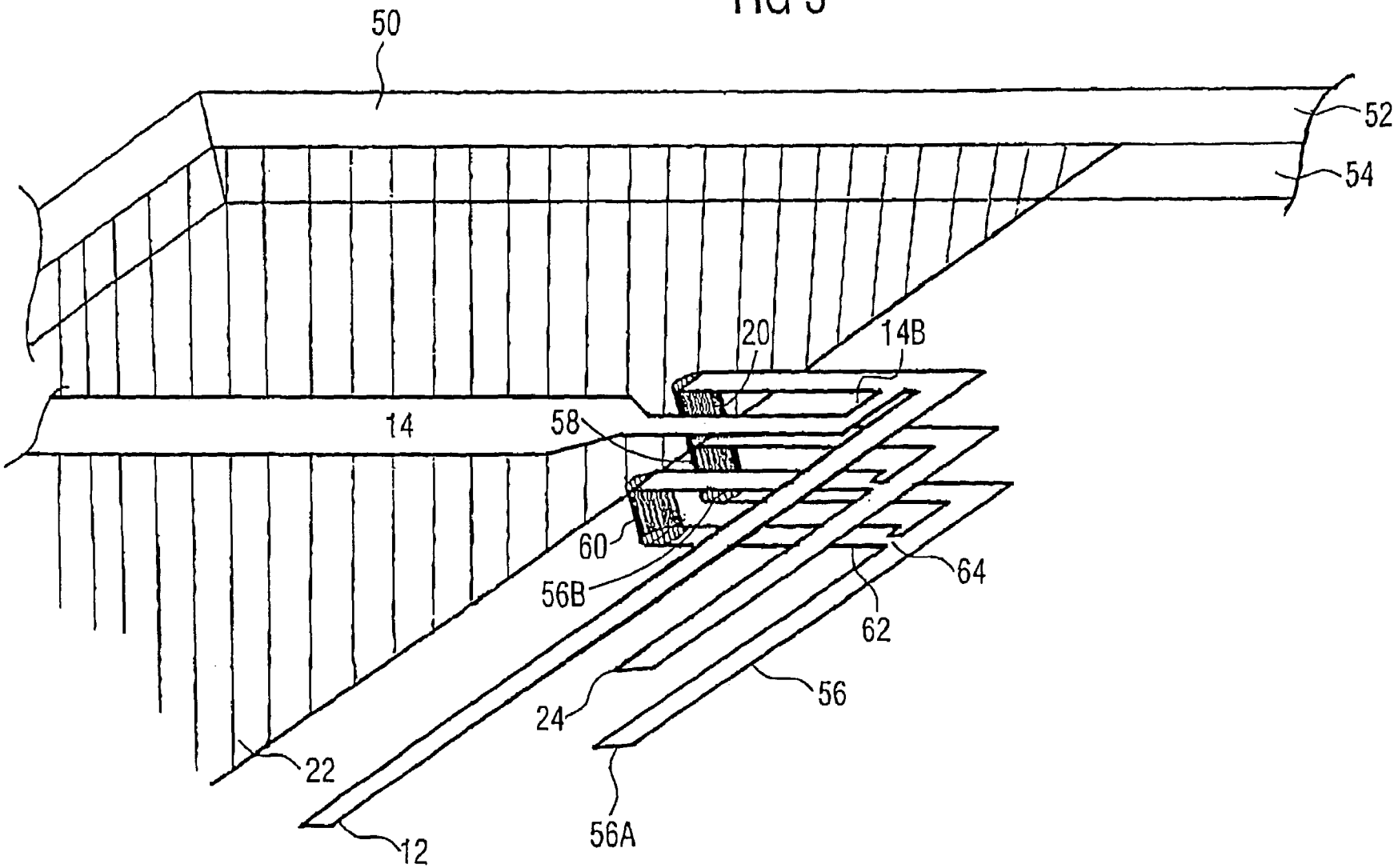
FIG. 3 is a schematic illustration of an alternative embodiment of an inventive antenna device.

A schematic illustration for an embodiment of an inventive multi-band antenna is shown in FIG. 3.

The multi-band antenna is implemented in a multi-layered substrate 50 which in turn is shown in a transparent manner for reasons of illustration and comprises a first layer 52 and a second layer 54. A first antenna element basically corresponding to the antenna element formed on the top side 10*a* of the substrate 10 comprising the first radiation electrode 12, is formed on the top side of the first layer 52, wherein, in contrast to the embodiment shown in FIG. 1, only the supply line 14 is connected to the part of the radiation electrode 12 perpendicular to the edge of the ground area 22 and thus has a corresponding portion 14*b*.

In analogy to the embodiment described above, the second radiation electrode 24 is formed on the bottom side of the first layer 52 (and on the top side of the second layer 54, respectively). A third radiation electrode 56 having an open end 56*a* and a short-circuited end 56*b* is formed on the bottom side of the second layer 54. The short-circuited end is connected to the ground electrode 22 via a through-connection 58 provided in the second layer 54. In addition, another through-connection 60 is provided in the second layer 54, via which a first end of a coupling line 62 is connected to the ground electrode 22. A second end of the coupling line 62 is connected to the third radiation electrode 56 at a coupling point 64.

The third antenna element comprising the radiation electrode 56 thus has a setup comparable to the setup of the second antenna element comprising the radiation electrode 24.

In the embodiment shown in FIG. 3, the third radiation electrode 56 is fed by at first inducing a current into the electric circuit of the second antenna element and by inducing a current into the electric circuit of the third antenna element by the current induced into the electric circuit of the second antenna element. This electric circuit of the third antenna element is formed by a conductor loop comprising the through-connection 60, the coupling line 62, the portion of the third radiation electrode 56 arranged between the coupling point 64 and the short-circuited end 56*b*, the through-connection 58 and the ground electrode 22.

As can be seen in FIG. 3, the respective feeding points and coupling points for the different antenna elements may be arranged at different positions to obtain matching for the respective different elements.

Alternatively to the embodiment shown in FIG. 3, the galvanically fed antenna element could be arranged between two inductively fed antenna elements so that no double magnetic coupling would be required for feeding the third antenna element.

In the embodiment shown in FIG. 3, instead of providing the through-connection 60, the first end of the coupling line 64 could be connected to the short-circuited end of the third radiation electrode 56 via a conductive track (not shown) provided on the bottom side of the second layer 54 to implement the electric circuit of the third antenna element. In such a case, only one respective through-connection would be required in both the first layer 52 and the second layer 54 of the multi-layered circuit board.

According to the invention, the several antenna elements can be used for producing a dual-band or multi-band antenna. Alternatively, respective additional antenna elements may be used for expanding the bandwidth of an individual frequency band by, for example, selecting the resonant frequencies of two antenna elements to be adjacent to each other.

Prototypes of inventive antenna devices have been simulated by means of HFSS and then formed on an Ro4003 substrate having an effective permittivity $\epsilon_r \approx 3.38$. An Ro4003 substrate is a high-frequency substrate by Rogers Corporation and is made of a glass-reinforced cured hydrocarbon/ceramics laminate. HFSS is an EM field simulation software by Ansoft Corporation for calculating S parameters and field configurations, which is based on the finite elements method.

Figure 4:
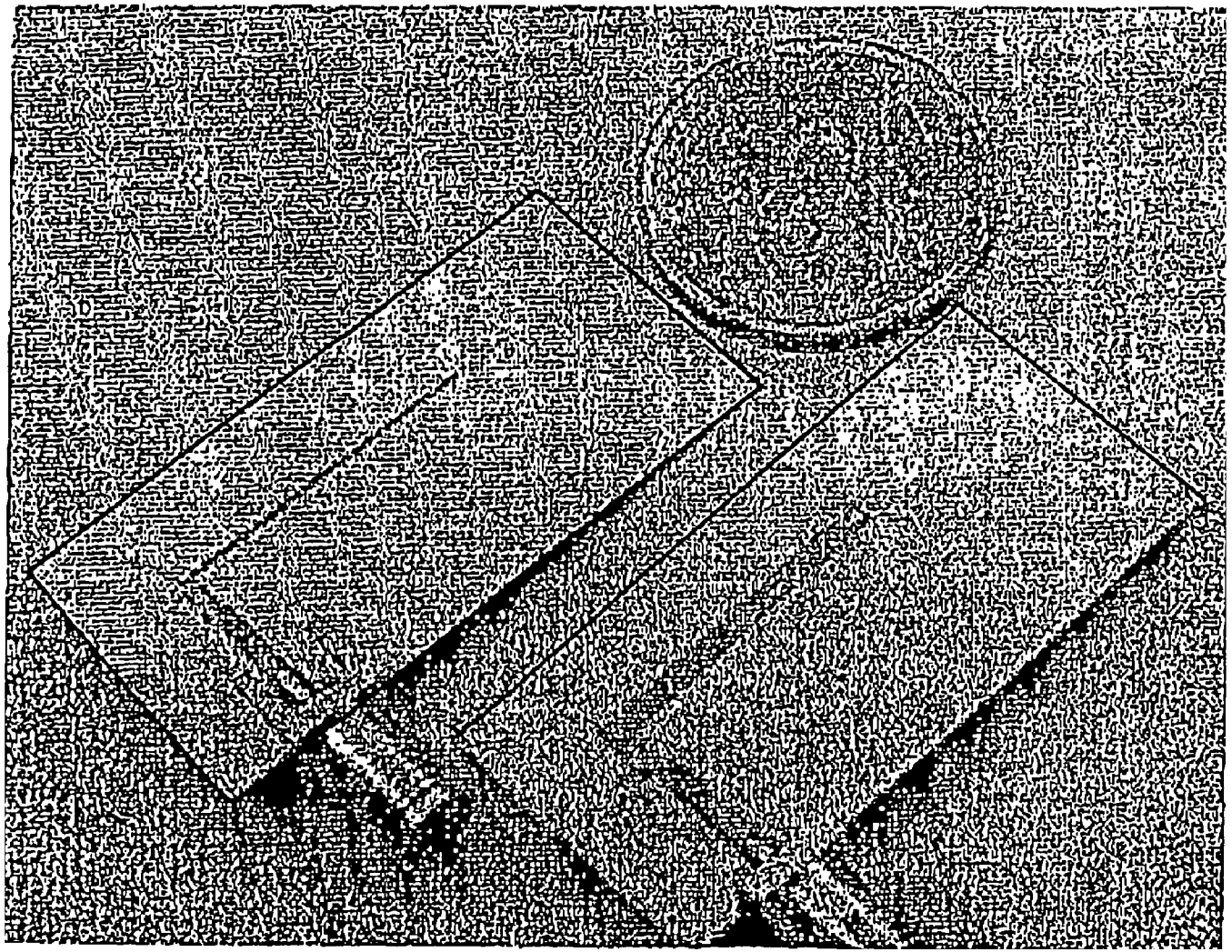
FIG. 4 is a schematic illustration of two antenna devices realized according to the invention.

FIG. 4 purely schematically shows photographies of two prototypes of this type in which the respective microstrip supply line is fed by a coaxial line. To illustrate size proportions, a 20 cent coin is also shown in FIG. 4. As can be seen in FIG. 4, the left antenna has a somewhat narrower radiation electrode, whereas the right antenna has a wider radiation electrode.

Figure 5A:
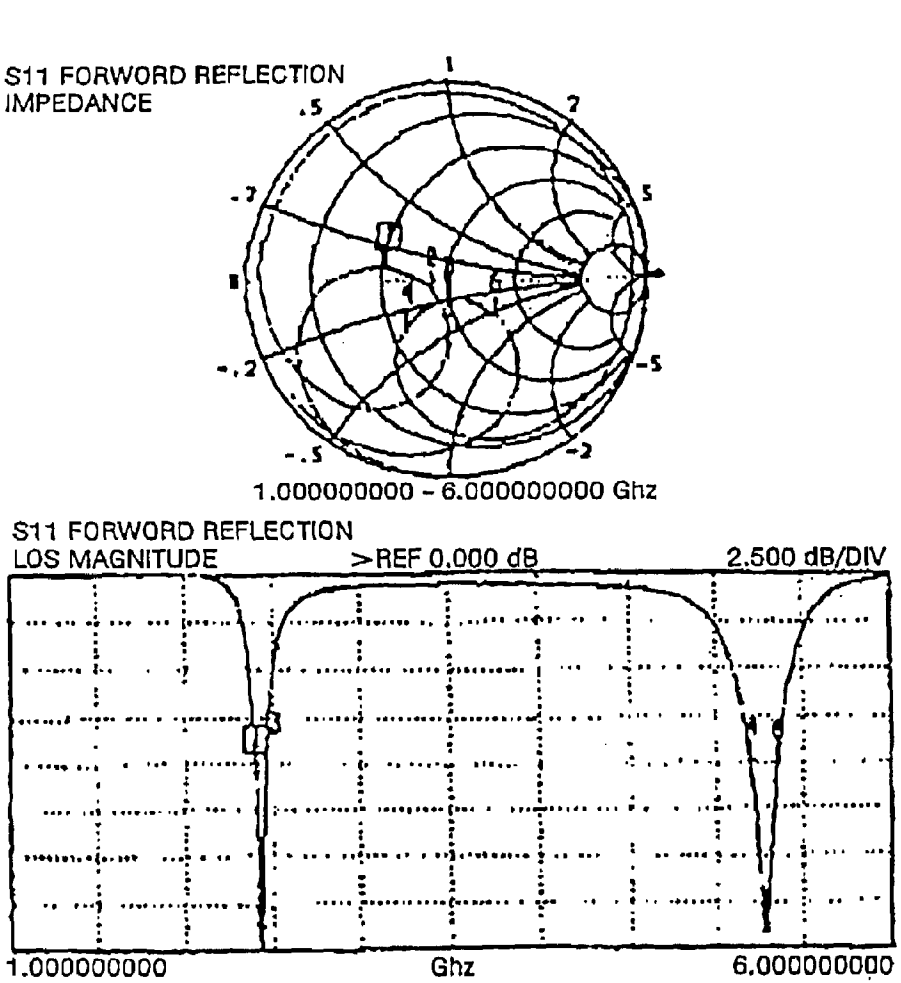
FIGS. 5*a* and 5*b* show characteristics measured of the antenna devices of FIG. 4.
Figure 5B:
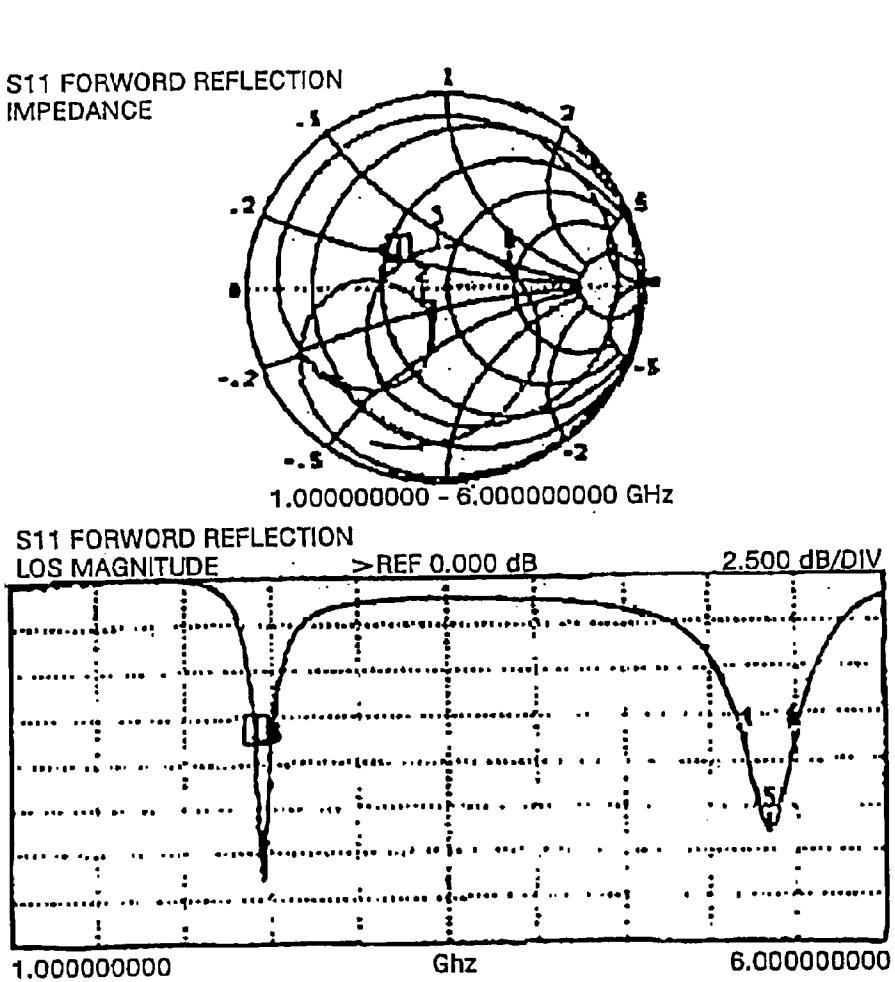

FIG. 5*a* shows the characteristics obtained in input reflection measurements of the left antenna of FIG. 4, whereas FIG. 5*b* shows the characteristics obtained with the right antenna of FIG. 4. As can be deduced from the graphs of FIGS. 5*a* and 5*b*, a change in bandwidth can be obtained by varying the geometry.

Even though setups having only two or three radiation electrodes have been described before, it is obvious that the inventive concept may also be extended to more than three radiation electrodes to obtain a corresponding multi-band capability or broad-band capability. For this purpose, a multi-layered substrate having more than two layers can be used in a suitable way. In addition, the present invention is not limited to the embodiments of antenna devices described but rather also includes single-sided printed antennas (where two or more radiation electrodes are provided on one surface of the substrate) or wire antenna assemblies.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An antenna device comprising a first radiation electrode comprising an open end and a short-circuited end connected to ground and being coupled to a feed line at a feeding point, wherein the feed line and a portion of the first radiation electrode between the feeding point and the short-circuited end define an exciter loop;

a second radiation electrode comprising an open end and a short-circuited end connected to ground, wherein a portion of the second radiation electrode is part of a conductor loop through which an alternating current may flow, wherein the exciter loop and the conductor loop are arranged spatially adjacent to each other such that an alternating current through the feed line to the short-circuited end of the first radiation electrode, for feeding the second radiation electrode, induces an alternating current into the conductor loop via magnetic coupling, wherein the second radiation electrode is arranged on a surface of a substrate on which, additionally, a ground area to which the short-circuited end of the second radiation electrode is connected is arranged, wherein, additionally, a coupling point of the second radiation electrode is connected to the ground area via a coupling conductor such that the part of the second radiation electrode between the short-circuited end and the coupling point, the coupling conductor and the ground area define the conductor loop through which an alternating current may flow.

2. The antenna device according to claim 1, wherein the first radiation electrode and the feed line are arranged on a first surface of a substrate and the second radiation electrode is arranged on a second surface of the substrate opposite the first surface.

3. The antenna device according to claim 1, wherein the exciter loop and the conductor loop, through which an alternating current may flow, are arranged opposite to each other, a substrate being arranged therebetween.

4. The antenna device according to claim 1, wherein the coupling point is selected such that there is matching between the impedance of the second radiation electrode and the impedance of the coupling line.

5. The antenna device according to claim 1, further comprising a third radiation electrode comprising an open end and a short-circuited end connected to ground, wherein a portion of the third radiation electrode is part of an electric current into which, for feeding the third radiation electrode, an alternating current may be induced by magnetic coupling by an alternating current through the feed line to the short-circuited end of the first radiation electrode or by an alternating current through the electric circuit associated to the second radiation electrode.

6. The antenna device according to claim 5, wherein the first, second and third radiation electrodes are arranged on different layers of a multi-layered substrate.

7. The antenna device according to claim 1, wherein the first and second radiation electrodes comprise different lengths to define antenna elements having different resonant frequencies.

* * * * *